US005692993A

United States Patent [19]

Dunn, Jr. et al.

[11] Patent Number: 5,692,993

[45] Date of Patent: Dec. 2, 1997

[54] LATERALLY MOVABLE RECREATIONAL EQUIPMENT DEVICE

[75] Inventors: James O. Dunn, Jr., Charlotte; Todd A. Coble, Stanfield; Jonathan E. Brooks, Charlotte, all of N.C.

[73] Assignee: Soft Play, L.L.C., Charlotte, N.C.

[21] Appl. No.: 633,587

[22] Filed: Apr. 17, 1996

[51] Int. Cl.[6] ..... A63B 9/00

[52] U.S. Cl. ..... 482/35; 482/36

[58] Field of Search ..... 482/35, 36, 23, 482/24; 472/95, 103, 104, 105, 116, 118, 135, 136, 77; 434/55, 58, 59, 247

[56] References Cited

U.S. PATENT DOCUMENTS

| | | | |
|---|---|---|---|
| 3,578,381 | 5/1971 | Young | 297/300 |
| 3,936,140 | 2/1976 | Ahrens | 272/54 |
| 4,379,550 | 4/1983 | Petersen | 272/52 |
| 4,995,603 | 2/1991 | Reed | 272/18 |
| 5,062,624 | 11/1991 | Reed | 272/1 |

*Primary Examiner*—Richard J. Apley
*Assistant Examiner*—William LaMarea
*Attorney, Agent, or Firm*—Polster, Lieder, Woodruff & Lucchesi, L.C.

[57] ABSTRACT

A laterally movable recreational device is disclosed. The device includes an enclosure having at least one opening for entry of an occupant and a support for suspending the enclosure above a floor or ground surface. The support and enclosure are constructed and connected to one another to facilitate movement of the enclosure in a predetermined path. There is a controlled fluid or resilient mounting of the enclosure relative to the support in the predetermined path in order to facilitate a controlled fluid or resilient movement of the enclosure relative to the support in the predetermined path when an occupant enters the enclosure. Preferably, the predetermined path in which movement of the enclosure relative to the support is facilitated is a lateral or horizontal path enabling controlled fluid or resilient movement of the enclosure relative to the support in such lateral or horizontal path. The device may be connected to one or more flexible tubes in a recreational play system environment to enable movement of the enclosure while remaining connected to the flexible tubes.

9 Claims, 3 Drawing Sheets

LATERALLY MOVABLE RECREATIONAL EQUIPMENT DEVICE

CROSS REFERENCE TO RELATED APPLICATIONS

This is a copending patent application of the following commonly assigned patent applications: Ser. No. 08/634,044, filed Apr. 17, 1996 entitled VERTICALLY MOVABLE RECREATIONAL EQUIPMENT DEVICE, Ser. No. 08/633,462, filed Apr. 17, 1996 entitled MULTI-DIRECTIONAL MOVABLE RECREATIONAL EQUIPMENT DEVICE, Ser. No. 08/633,662, filed Apr. 17, 1996, entitled MOVABLE OCCUPANT DIRECTED RECREATIONAL EQUIPMENT DEVICE, and Design patent application Ser. No. 29/55,394, filed Jun. 5, 1996 entitled RECREATIONAL EQUIPMENT DEVICE, now U.S. Pat. No. Des. 381,386.

BACKGROUND OF THE INVENTION

Children's outdoor playground or recreational equipment that facilitates movement is quite popular. In addition to swing sets, rotating or whirling devices and teeter-totters, children love to sit on spring mounted riders that have various animal and other shapes. Typically, such spring mounted riders have coil springs or leaf springs that extend between the ground and the rider. As a result, children can sit on the rider and create their own bouncing and rocking movements. Examples of such devices are shown in U.S. Pat. Nos. 3,578,381; 3,836,140; 4,379,550; and in the Miracle Recreation Equipment Company 1995 Park and Playground Catalog at pages 79–80.

Children's indoor playground or recreational equipment does not readily offer various moving type play devices. Space, along with safety, restricts the availability of various types of movable recreational equipment. This is also true of tubular play systems and enclosures through which children crawl or move, such as shown, for example, in Soft Play, L.L.C.'s 1995 "Value Series" brochure. Where an indoor recreational play system includes such tube and junction boxes or other enclosures through which children crawl or move, it would be desirable to provide movement of the junction box, enclosures or other elements. Although children enjoy being confined in a mirage or tubes and enclosures in such tubular play equipment, in order to create a more interesting environment, it has been discovered that it is possible to provide for movement of the enclosures or other elements, while enabling such elements to remain connected to generally flexible components in the tubular play equipment.

There are some rotating and tilting enclosures which are separate, free standing devices, including for example, U.S. Pat. Nos. 4,995,603 and 5,062,624. However, when enclosures are part of a recreational play system that includes connected tubes and enclosures, it would be particularly desirable to provide for movement of the enclosures or other elements, while enabling same to remain connected to generally flexible tubes or other components in the tubular play equipment.

The present invention relates to a laterally movable recreational equipment device, as distinct from the multi-directional, vertically movable or occupant directed recreational equipment devices as identified in the aforementioned patent applications.

SUMMARY OF THE INVENTION

Accordingly, among the several objects and advantages of the present invention include:

The provision of a laterally movable recreational equipment device;

The provision of the aforementioned laterally removable recreational equipment device which, when used as a component in a recreational play system, allows for movement of the device while remaining connected to flexlible tubular or other elements in the recreational play system;

The provision of the aforementioned laterally movable recreational equipment device which provides for controlled fluid or resilient movement of the device in a lateral or horizontal path while being suspended relative to a support;

The provision of the aforementioned laterally movable recreational equipment device in which entry of an occupant provides controlled fluid or resilient movement of the device relative to the support;

The provision of the aforementioned laterally movable recreational equipment device which provides smooth and safe movement in a controlled environment;

The provision of the aforementioned laterally movable recreational equipment device which provides for lateral or horizontal movement relative to a support while restricting vertical or up and down movement of the device relative to the support;

The provision of the aforementioned laterally movable recreational equipment device which facilitates controlled fluid or resilient movement of the device relative to the support in a lateral or horizontal path; and The provision of the aforementioned laterally movable recreational equipment device which can be quickly and economically manufactured; is easy to use and maintain; is made of a minimum number of parts; is safe in operation; and is otherwise well adapted for the purposes intended.

Briefly stated, the laterally movable recreational equipment device of the present invention includes an enclosure having at least one opening for entry of an occupant. A support suspends the enclosure above a floor or ground surface. The support and enclosure are constructed and connected to one another to restrict movement of the enclosure in a predetermined path. Means are provided for controlled fluid mounting of the enclosure relative to the support in the predetermined path in order to facilitate controlled fluid movement of the enclosure relative to the support in the predetermined path when an occupant enters the enclosure.

Preferably, the predetermined path in which movement is facilitated is in a horizontal or lateral direction.

For the controlled fluid movement, spring means may be provided for resiliently mounting the enclosure relative to the support in order to permit resilient movement of the enclosure relative to the support in the predetermined path when an occupant enters the enclosure.

The support may be mounted to the enclosure through a cantilevered construction. Such cantilever construction may include upper and lower cantilever supporting elements extending between the enclosure and the support. Each cantilever element may include a coil spring that extends between the enclosure and the support.

For the aforementioned spring means, upper spring means may be mounted between the enclosure and the support on opposite sides of at least the upper cantilever supporting element. The one pair of spring means are preferably coil springs having less predetermined strength than the coil spring of each cantilever supporting element.

The laterally movable recreational equipment device is preferably part of a recreational play system environment including one or more flexible tubes received in complementary shaped openings of the enclosure which provides movement of the enclosure relative to the support without disconnection from the flexible tubes in the recreational play system environment.

These and other objects and advantages of the present invention will become apparent from the description that follows.

BRIEF DESCRIPTION OF THE DRAWINGS

Corresponding reference numerals will be used throughout the several figures of the drawings.

DESCRIPTION OF THE PREFERRED EMBODIMENTS

The following detailed description illustrates the invention by way of example and not by way limitation. This description will clearly enable one skilled in the art to make and use the invention, and describes several embodiments, adaptions, variations, alternatives and uses of the invention, including what I presently believe is the best mode of carrying out the invention.

Figure 5:
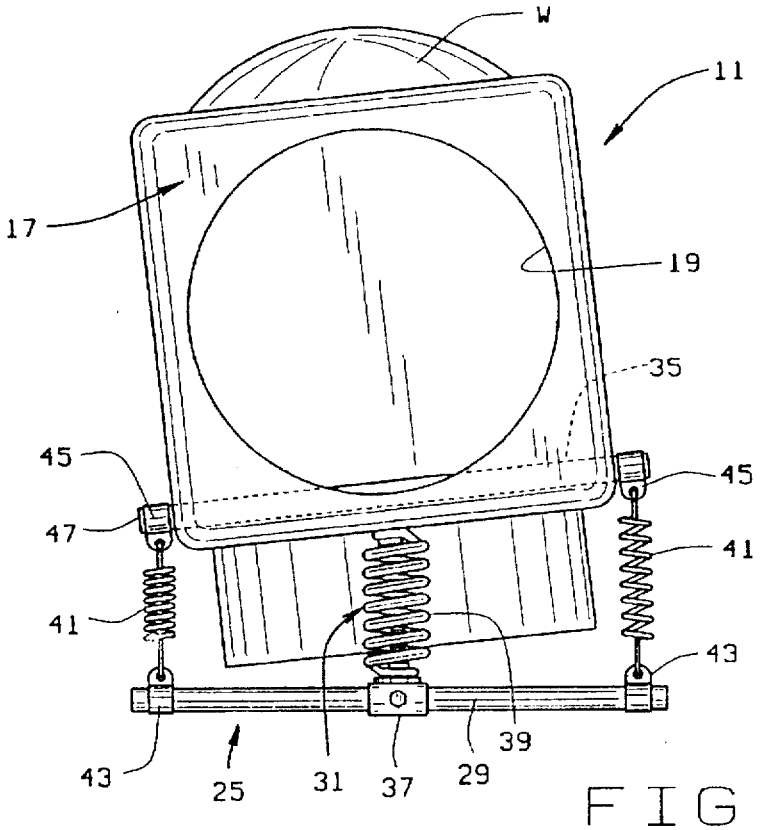
FIG. 5 is a top plan view similar to FIG. 4, but showing the laterally movable recreational device moving from the position shown in FIG. 4 to a laterally displaced position as illustrated in FIG. 5.

In order to understand a typical and preferred recreational play system in which the laterally movable recreational equipment device of the present invention may be used, reference is first made to FIG. 5 of the drawings.

Figure 6:
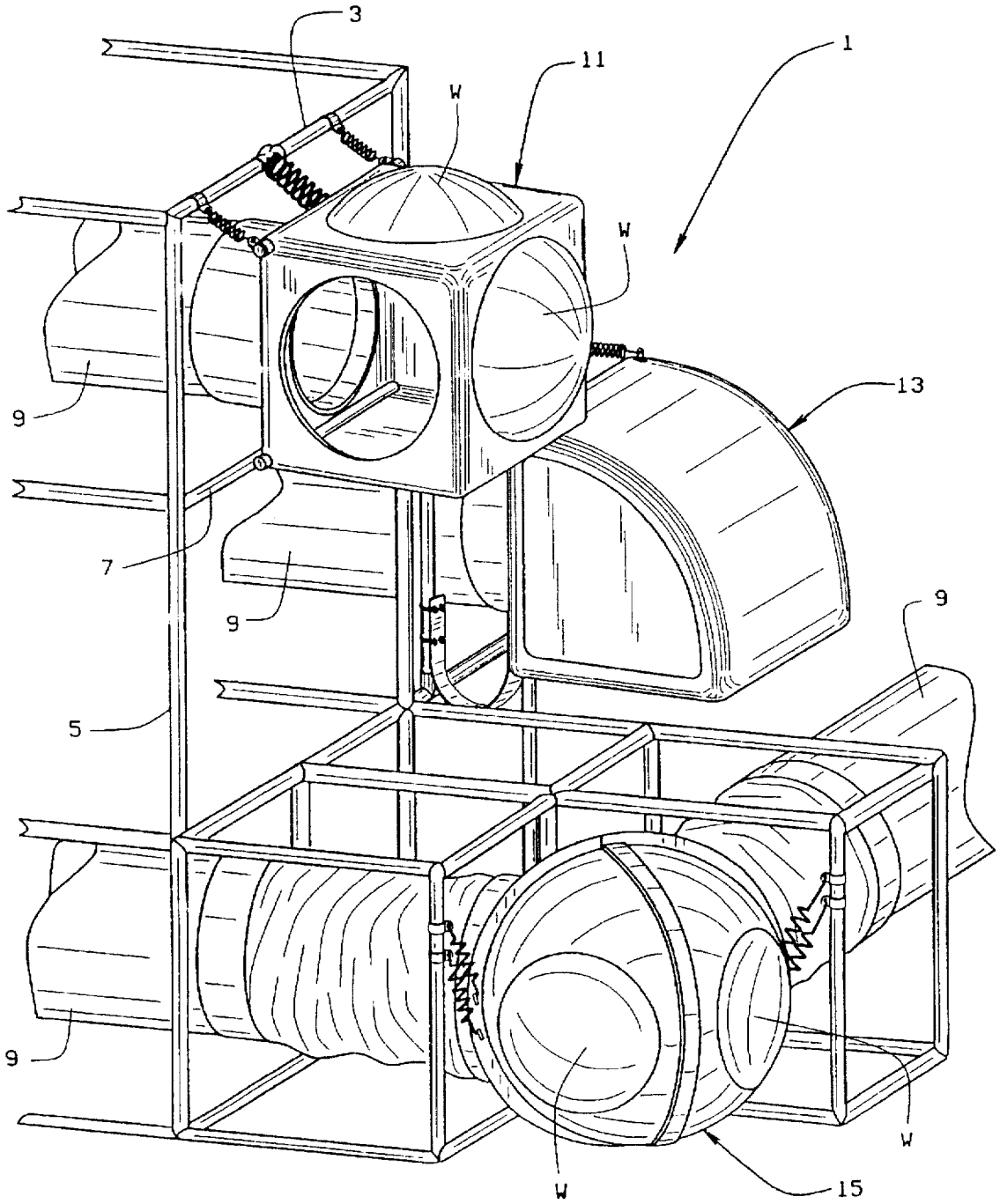
FIG. 6 is a perspective view of a typical tubular play system environment, including a plurality of tubes and enclosures, as well as the laterally movable recreational equipment device of the present invention.

As illustrated in FIG. 6, a recreational play system 1 may include a supporting structure 3 have a series of interconnected vertical struts 5 and horizontal struts 7 for supporting an interconnected tubular and enclosure play structure. The interconnected tubular and enclosure play structure may include interconnected elongated tubes 9 and enclosures 11, 13, and 15 which are arranged at various respective heights in the supporting structure 3, or in any other desired arrangement. The interconnected tubes 9 and enclosures 11, 13, and 15 enable children to crawl or move through the interconnected tubes and enclosures for a fun play experience. The enclosures 11, 13, and 15 may be connected to one or more tubes 9 and may include the use of transparent windows W in the enclosures, as illustrated in each of the enclosures 11 and 15.

Typically, the enclosures 11, 13, and 15 have been static structures in that they have been attached in a fixed position to the vertical struts 5 and/or horizontal struts 7. However, it is possible to construct the suspended enclosures 11, 13, and 15 in order to provide a safe and controlled fluid or resilient movement in one or more directions, in order to enhance the play experience of children when entering the enclosures 11, 13, and 15. At the same time, the enclosures 11, 13, and 15 remain connected to the tubes 9, as will become apparent.

Each of the enclosures 11, 13, and 15 are the subject of separate utility patent applications as follows: enclosure 13 is the subject of copending patent application Ser. No. 08/634,044 filed Apr. 17, 1996 entitled VERTICALLY MOVABLE RECREATIONAL EQUIPMENT DEVICE, enclosure 15 is the subject of copending patent application Ser. No. 08/633,462 filed Apr. 17, 1996 entitled MULTI-DIRECTIONAL MOVABLE RECREATIONAL EQUIPMENT DEVICE, and enclosure 11 is the subject of the present patent application and is directed to the movement of the enclosure in a generally lateral or horizontal path or direction, as will become apparent from the description that follows.

In the discussion that follows, the term "fluid" or "resilient" mounting is defined as a movable and/or changeable mounting structure, and includes resilient devices such as springs or other shock absorbing elements, as well as fluid (air or liquid) cylinders or other structure, which are able to move and change shape without separating under force or pressure. In the same sense, the term "fluid" or "resilient" movement is defined to include movable and/or changeable positions or movement along a predetermined path.

The laterally movable recreational equipment device 11 may be used by itself, as illustrated in FIGS. 1–2 and 4–5 of the drawings; however, preferably it is part of the recreational play system 1 as illustrated in FIG. 6 of the drawings. The laterally movable recreational equipment device 11 includes an enclosure 17 generally having a square shaped hollow box configuration that is roto-molded from suitable plastic material, polyethylene being one preferred example. The enclosure 17 may be modified and configured in various ways to include a different number and locations of connected tubes, windows and ventilator panels, as may be desired. Thus, the enclosure 17 may have any desired shape, as long as it has at least one opening 19 for entry of an occupant.

Figure 1:
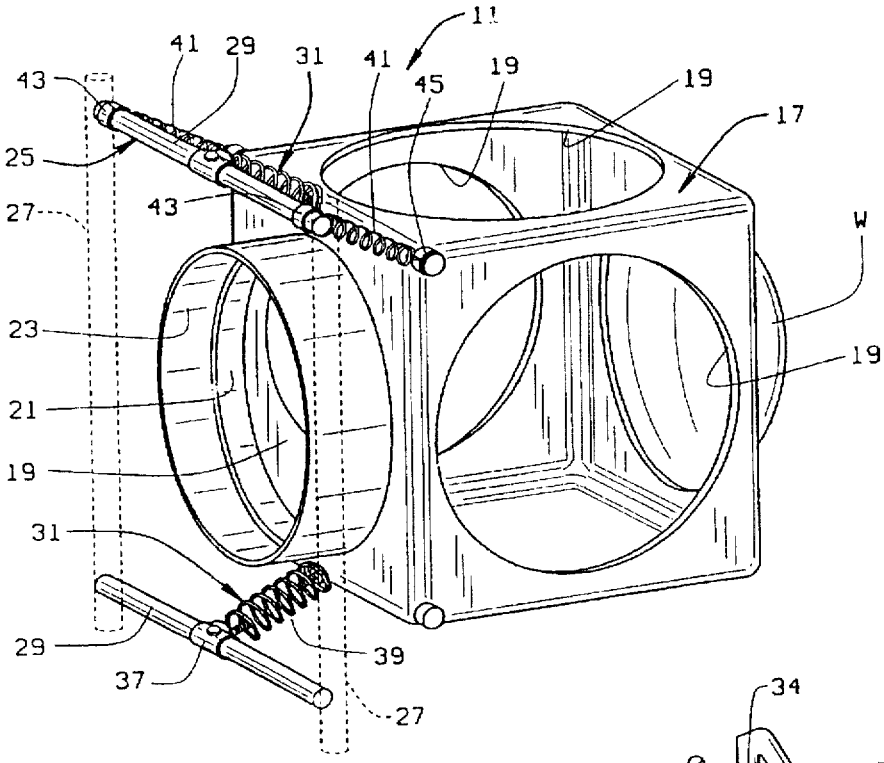
FIG. 1 is a rear perspective view of the laterally movable recreational equipment device of the present invention.

As best illustrated in FIG. 1 of the drawing, there are a series of openings 19 formed in the enclosure 17. One of the openings 19, at the left hand side of the enclosure 17 in FIG. 1 of the drawings, is surrounded by an integral connective tubular neck 21 with a complementary shaped tube 23 surrounding the connective tubular neck 21. Alternatively, the connective tubular neck 21 may be separately formed from the enclosure and inserted and secured to the enclosure 17 within the opening 19. In either instance, the complementary shaped tube 23 is preferably a flexible tube that accommodates movement of the enclosure 17. For this purpose, the flexible tube may be constructed to allow flexing or be made of a material such as webbing that inherently permits flexing, such as the flexible tubes associated with the enclosure 15. The other openings 19 and the enclosure 17 may be used for complementary shaped flexible tubes 23, if desired, or for windows W or ventilator panels or any other element, as may be desired in the preferred arrangement of the recreational play system 1.

The laterally movable recreational equipment device 11 further includes a support 25 for suspending the enclosure 17 above a floor or ground surface. The support 25 includes spaced vertical struts 27, 27 (shown in dotted lines) that are interconnected at opposite ends to spaced horizontal struts 29, 29. The enclosure 17 and the support 25 are constructed and connected to one another to facilitate movement of the enclosure 17 in a predetermined path which, as will be seen from the discussion below, is a path that is generally in a lateral or horizontal direction.

In order to provide movement of the enclosure 17 relative to the support 25 in a desired predetermined path, the movable recreational equipment device 11 includes means for controlled fluid or resilient mounting of the enclosure 17 relative to the support 25 in order to permit controlled fluid or resilient movement of the enclosure 17 relative to the support 25 in the desired predetermined path which, as will be seen below, is in a lateral or horizontally directed path.

In the embodiment illustrated in FIGS. 1–5 of the drawings, spring means are illustrated for the fluid or resilient mounting of the enclosure 17 relative to the support 25 in order to permit resilient or fluid movement of the enclosure 17 relative to the support 25 in the desired lateral or horizontal path.

Figure 3:
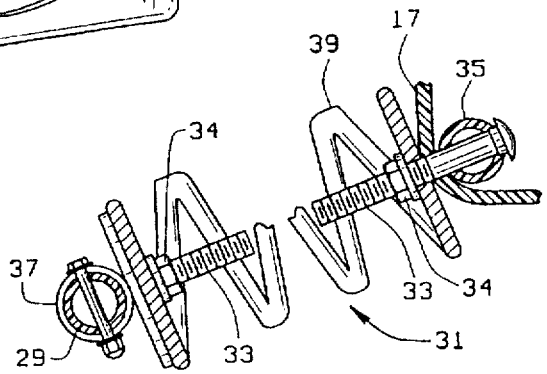
FIG. 3 is an enlarged fragmentary side elevational view, partly in section, of one of the cantilever supporting elements used in the laterally movable recreational equipment device of the present invention.
Figure 2:
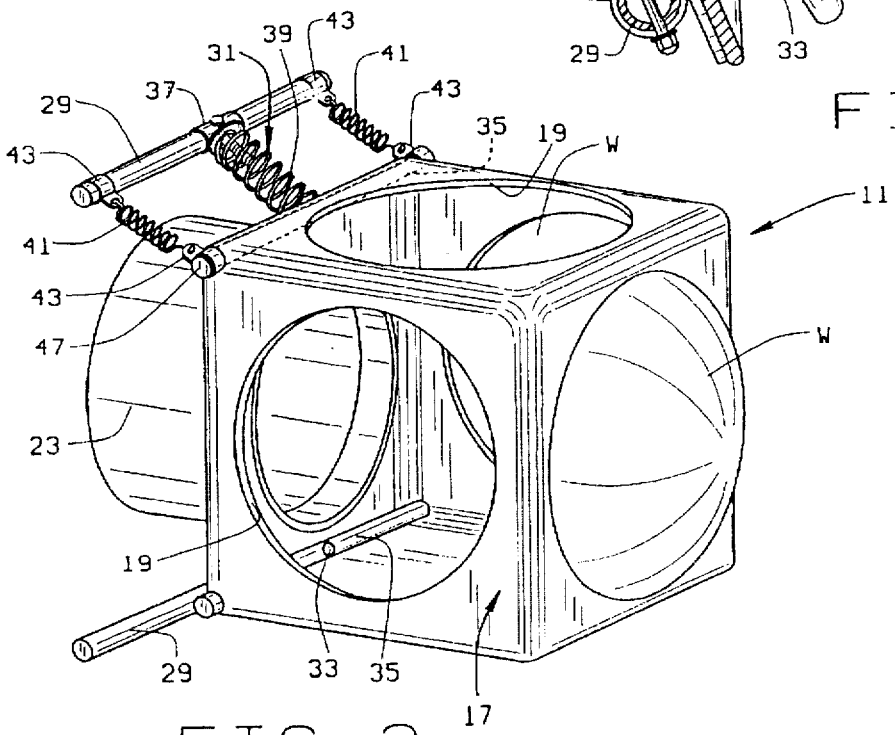
FIG. 2 is a front perspective view of the laterally movable recreational equipment device of the present invention.

Specifically, a pair of upper and lower cantilever supporting elements 31, 31 extend between the enclosure 17 and upper and lower horizontal struts 29, 29. It will be noted that each of the upper and lower cantilever supporting elements 31, 31 are positioned approximately at the mid point of the horizontal struts 29, 29 and a corresponding mid point of the enclosure 17 along one of its sides. Each of the cantilever supporting elements 31 include a bolt and nut 33, 34 that connects a coil spring 39 to a horizontal strut 29 at one end, as well as a second bolt and nut 33, 34 that connects the coil spring 39 to an inner horizontal strut 35 within the enclosure 17, as best seen in FIG. 2 of the drawings. As will be seen, bolt 33 extends through the inner horizontal strut 35 that is within the enclosure 17, as shown in FIGS. 2–3. The other bolt 33 is connected by a pipe element 37 that surrounds the horizontal strut 29, as best seen in FIG. 3. A coil spring 39 extends between the enclosure 17 and each upper and lower horizontal strut 29. With each cantilever supporting element 31 mounted at the mid-point of the enclosure 17 and the upper and lower horizontal struts 29, 29, it will be understood that an occupant within the enclosure 17 will cause a twisting or rocking movement of the enclosure 17 relative to the support 25 in a general horizontal path.

To facilitate such twisting or rocking lateral or horizontal movement of the enclosure 17 relative to the support 25, a pair of upper coil springs 41 are mounted between the enclosure 17 in the upper horizontal strut 29. Each coil spring 41 is attached through a strap 43 to the upper horizontal strut 29 at one end while being attached at an opposite end to a second strap 45 that extends around the outer ends 47 of an upper inner horizontal strut 35 that is positioned within the enclosure 17. Each of the upper coil springs 41, 41 have less predetermined strength than the coil spring 39 of each cantilever supporting element 31. This provides a smooth, safe and controlled twisting or rocking movement of the enclosure 17. Thus, controlled fluid or resilient movement of the enclosure 17 relative to the support 25 in a lateral or horizontal path is accomplished.

Figure 4:
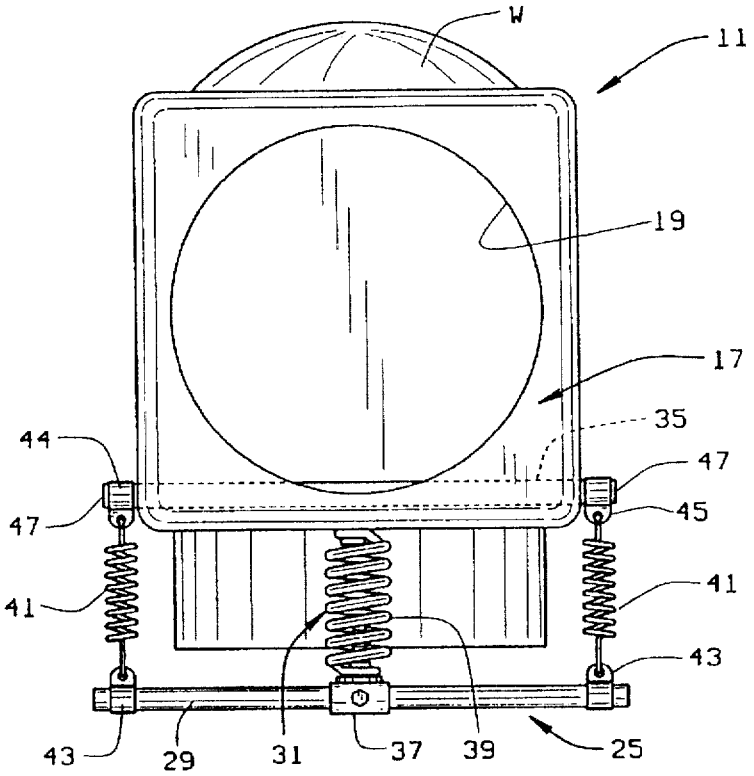
FIG. 4 is a top plan view of the laterally movable recreational equipment device of the present invention.

As best seen in FIGS. 4–5 of the drawings, the lateral or horizontal rocking or twisting movement of the enclosure 17 relative to the support 25 is illustrated. Note in FIG. 3 that the enclosure 17 is shown in a fixed or non-movable position, just prior to the entry of an occupant within the enclosure 17. However, an occupant within the enclosure 17 may move the enclosure 17 relative to the support 25 from the position illustrated in FIG. 4 to that illustrated in FIG. 5. As shown in FIG. 5, the enclosure 17 is illustrated as being moved to the left causing the left upper coil spring 41 to be compressed while the right upper coil spring 41 is extended as the enclosure 17 is moved in its cantilevered rocking or twisting movement by the upper and lower cantilever supporting elements 31, 31.

The controlled fluid or resilient movement of the enclosure 17 relative to the support 25 is dependent, in part, on the weight and/or movement of an occupant within the enclosure as well as the relative strength and resiliency of the coil springs 39 of each cantilever supporting element 31 and the upper coil springs 41, 41. In any case, an appropriate balance can be struck for the aforementioned coil springs in order to accommodate an average weight of typical occupants that would enter the enclosure 17, as will be appreciated.

From the foregoing, it will now be appreciated that the moving recreational equipment device of the present invention, whether used independently or in conjunction with the recreational play system illustrated in FIG. 6 of the drawings, provides a smooth, safe and controlled fluid or resilient movement of the enclosure 17 relative to the support 25 in a lateral or horizontal path. As illustrated in the drawings, such movement is typically a twisting or rocking movement of the enclosure 17 relative to the support in the lateral or horizontal path. At the same time, the enclosure 17 is maintained in connected relationship to one or more flexible tubes that form a recreational play system environment.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A moving recreational equipment device, including:

an enclosure having multiple sides and an opening in one side for entry of an occupant;

proximate support structure immediately adjacent only the one side of the enclosure having the opening for suspending the enclosure above a floor surface;

said proximate support structure and enclosure being constructed and connected to one another to facilitate movement of the enclosure relative to the proximate support structure in a lateral path while restricting movement in a vertical path; and spring means extending between the one side of the enclosure having the opening and the proximate support structure for resilient mounting of the enclosure relative to the proximate support structure in the lateral path in order to permit resilient movement of the enclosure relative to the proximate support structure in the lateral path when an occupant enters the enclosure.

2. The moving recreational equipment device as defined in claim 1 in which the enclosure is mounted to the support through a cantilevered construction.

3. The moving recreational equipment device as defined in claim 2 and including upper and lower cantilever supporting elements extending between the enclosure and support.

4. The moving recreational equipment device as defined in claim 3 in which each cantilever supporting element includes a coil spring that extends between the enclosure and the support.

5. The moving recreational equipment device as defined in claim 4 in which one pair of upper spring means are mounted between the enclosure and support on opposite sides of at least the upper cantilever supporting element.

6. The moving recreational equipment device as defined in claim 5 in which the pair of spring means are coil springs each having less predetermined strength then the coil spring of each cantilever supporting element.

7. The moving recreational equipment device as defined in claim 1 in which the at least one opening in the enclosure is connected to a complementary shaped flexible tube in a recreational equipment play system, said flexible tube remaining connected to the enclosure during movement of the enclosure by an occupant.

8. A moving recreational equipment device, including:

an enclosure having at least one opening for entry of an occupant;

proximate support structure immediately adjacent the enclosure for suspending the enclosure above a floor surface;

upper and lower cantilever supporting elements extending between the enclosure and support to facilitate lateral movement of the enclosure relative to the support;

coil spring means on opposite sides of at least the upper cantilever supporting element, each of the coil spring means having less predetermined strength than the cantilever supporting elements in order to permit lateral resilient movement of the enclosure relative to the support when an occupant enters the enclosure; and each cantilever supporting element includes a coil spring that extends between the enclosure and the support, each cantilever supporting element coil spring having a greater predetermined strength than spring means on opposite sides of at least the upper cantilever supporting element.

9. The device as defined in claim 8 in which one or more flexible tubes are connected to the enclosure by being connected to a corresponding number of complementary shaped openings in the enclosure, said one or more flexible tubes remaining connected to the enclosure during movement of the enclosure by an occupant.

* * * * *